US005594535A

United States Patent [19]

Beaufort et al.

[11] Patent Number: 5,594,535

[45] Date of Patent: Jan. 14, 1997

[54] REFILLABLE TONER CARTRIDGE

[75] Inventors: Richard F. Beaufort, Boise; Robin P. Yergenson, Eagle; Howard G. Hooper, Boise, all of Id.

[73] Assignee: Hewlett-Packard Company, Palo Alto, Calif.

[21] Appl. No.: 553,218

[22] Filed: Nov. 7, 1995

[51] Int. Cl.[6] ..... G03G 15/06

[52] U.S. Cl. ..... 399/262; 222/DIG. 1; 414/411; 399/106

[58] Field of Search ..... 355/260; 206/816; 414/411; 222/160, 325, DIG. 1; 220/350, 359

[56] References Cited

U.S. PATENT DOCUMENTS

| | | | |
|---|---|---|---|
| 4,816,877 | 3/1989 | Keen | 355/133 |
| 5,185,616 | 2/1993 | Wilcke | 346/1.1 |
| 5,392,963 | 2/1995 | Kelly et al. | 222/325 |

*Primary Examiner*—Arthur T. Grimley
*Assistant Examiner*—Quana Grainger
*Attorney, Agent, or Firm*—Anthony J. Baca

[57] ABSTRACT

An apparatus for refilling an electrophotographic imaging system. A refill pack is constructed around a frame. A collapsible bag, which is permanently attached to the top of the frame, along with a removable seal, which is attached to the bottom of the frame, defines an internal volume that contains the developer particles. The refill pack attaches to a receiving area on the cartridge. A new cartridge includes a flexible cover attached over an opening in the receiving area. Once the refill pack is attached to the receiving area, the removable seal is removed. As the removable seal is removed, a cutting edge on the removable seal cuts the flexible cover, opening the cartridge. Removal of the removable seal also releases the developer particles from the internal volume, allowing them to enter the cartridge thereby refilling the cartridge. Additional refill packs may be added over the top of a spent refill pack. However, the receiving area of the cartridge allows a maximum number of refill packs.

8 Claims, 13 Drawing Sheets

REFILLABLE TONER CARTRIDGE

TECHNICAL FIELD

The present invention relates to a toner cartridge used in electrophotographic imaging systems and more particularly, to a new toner cartridge design that can be easily refilled.

BACKGROUND OF THE INVENTION

Electrophotographic processes for producing a permanent image on media are well known and commonly used. In general, these processes all include: (1) charging a photoreceptor which is a roller or continuous belt bearing a photoconductive material; (2) exposing the charged area to a light image to produce an electrostatic charge on the area in the shape of the image; (3) presenting developer particles (toner) to the photoreceptor surface bearing the image so that the particles are transferred to the surface in the shape of the image; (4) transferring the particles in the shape of the image from the photoreceptor to the media; (5) fusing or fixing the particles in the shape of the image to the media; and (6) cleaning or restoring the photoreceptor for the next printing cycle. Further information about alternative photographic processes is available in the text "The Physics and Technology of Xerographic Processes", by Edgar M. Williams, 1984, a Wiley-Interscience Publication of John Wiley & Sons, the disclosure of which is hereby incorporated by reference.

Many image forming apparatus utilize the electrophotographic printing process, examples being laser printers, copy machines, and facsimile machines. As described above, these image forming apparatus use toner to print or copy the desired image or words onto a piece of paper or media. The toner is contained in a hopper, which must be refilled periodically. For example, the toner in a laser printer must be refilled after printing approximately 1000 pages.

The process of refilling the toner hopper has proven to be difficult and messy. Toner, the "ink" of the print or copy machine, is a powdery substance that must be applied evenly across the surface of the photoconductive drum during use. However, toner that leaks out of the hopper during shipping can accumulate on the drum and cause blotching, streaking or voiding of prints and copies. Toner leakage can also cause moving parts to wear out more rapidly and may even short out the electrical components in the cartridge. In these ways, toner leakage reduces the quality of prints and copies, increases maintenance cost, and can even decrease the useful life of the image forming machine.

To resolve the problems associated with toner refilling, a disposable toner cartridge is generally used. This cartridge typically includes a toner hopper, seal assembly, mounting member, magnetic roller assembly, photoconductive drum assembly and corona assembly. By combining these components in to a single cartridge, toner is applied equally across the surface of the drum without leaking out of the hopper during shipping. Unfortunately, this cartridge design is relatively expensive. In addition, the magnetic roller, drum and corona assemblies last considerably longer than 1000 pages. Thus, the disposal of the entire cartridge results in unnecessary waste of material and landfill space with the costs being passed on to the consumer.

Toner leakage is prevented by the seal assembly which is typically provided with a removable seal member. Once this seal member is removed, toner is allowed to flow out of the toner hopper opening onto the charged developer sleeve and across the surface of the drum as understood by one skilled in the art. Removal of the seal member also allows toner to permeate throughout the entire cartridge if shaken or flipped upside down. Consequently, the seal member is usually not removed until after the cartridge has been inserted into an image forming machine.

Presently, recycling the cartridge requires the recycles to collect old cartridges, bring them to their workshops, empty out waste toner and add new toner. The recycled cartridge are then deliver them back to the consumer. Attempts to do the same in the workplace, have resulted in problems particularly related to the inherent messiness of the procedure.

SUMMARY OF THE INVENTION

The present invention is an apparatus for refilling an electrophotographic imaging system. A limited number of refill packs can be snapped onto a cartridge. The refill pack is constructed around a frame. A collapsible bag, which is permanently attached to the top of the frame, along with a removable seal, which is attached to the bottom of the frame, defines an internal volume that contains the developer particles.

The refill pack attaches to a receiving area on the cartridge. In the receiving area of the cartridge, there is an opening passing from within the cartridge to outside the cartridge. A new cartridge includes a flexible cover attached over the opening in the receiving area.

Once the refill pack is attached to the receiving area, the removable seal is removed. As the removable seal is removed, a cutting edge on the removable seal cuts the flexible cover, opening the cartridge. Removal of the removable seal also releases the developer particles from the internal volume, allowing them to enter the cartridge thereby refilling the cartridge.

In the preferred embodiment, additional refill packs may be added over the top of a spent refill pack. However, the receiving area of the cartridge allows a maximum number of refill packs.

A one-time refillable design is described as an alternative embodiment. In the alternative embodiment, the removable seal includes a tab that locks into the flexible cover when the refill pack is attached to the cartridge. Extraction of the removable seal also extracts the flexible cover.

BRIEF DESCRIPTION OF THE DRAWINGS

A better understanding of the invention may be had from the consideration of the following detailed description taken in conjunction with the accompanying drawings in which.

DETAILED DESCRIPTION OF THE PREFERRED EMBODIMENTS

Figure 1:
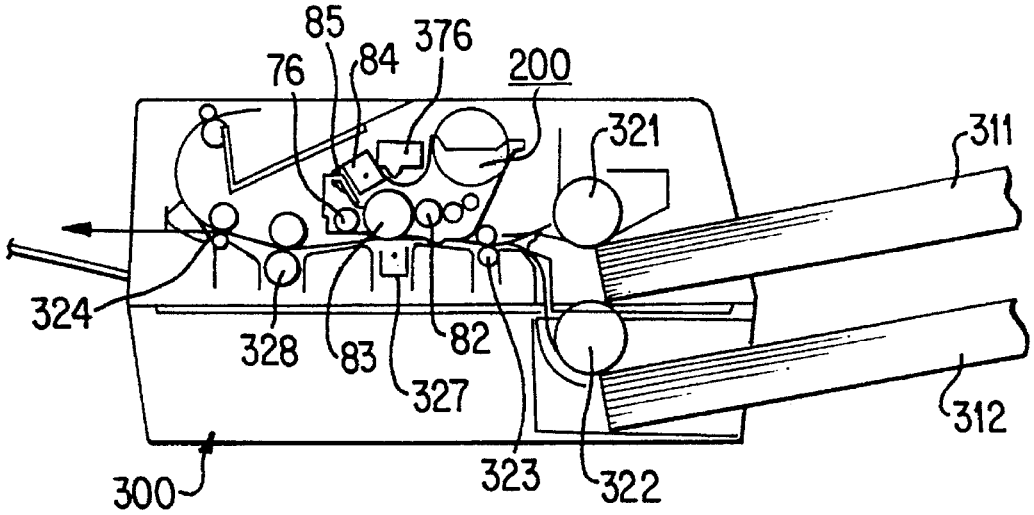
FIG. 1 is a perspective view of the preferred embodiment in accordance with the present invention.

The present invention is not limited to a specific embodiment illustrated herein. Referring first to FIG. 1, the electrophotographic printer 300 has therein feed rollers 321 and 322 for feeding the printing sheets stacked in the printing sheet cassettes 311 and 312, a pair of rollers 323 for conveying a printing sheet fed from the printing sheet cassettes 311 or 312, an exposure array 376 for emitting light to the photosensitive drum 83 for thereby forming an electrostatic latent image on the photosensitive drum 83, a transfer electrostatic charger 327 for transferring toner from the photosensitive drum 83 to the printing sheet, a pair of heat rollers 328 for fixing the toner transferred on the printing sheet and a toner cartridge 200.

The toner cartridge 200 has an electrostatic charger 84 for electrostatic charging the photosensitive drum 83 uniformly, a cleaner 76 for eliminating the untransferred or waste toner on the photosensitive drum 83 as well as the developing roller 82 and the photosensitive drum 83.

Figure 2:
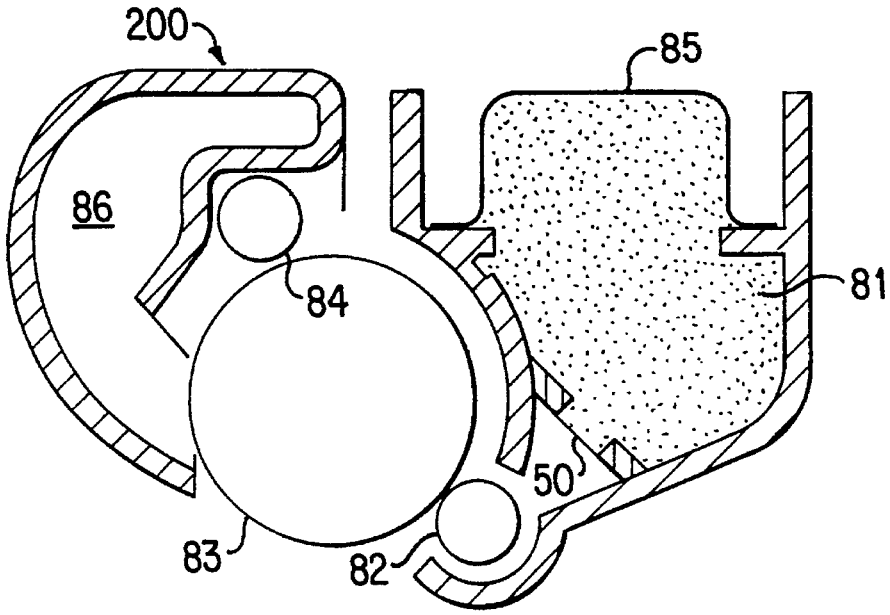
FIG. 2 is a simplified cross sectional view of a new toner cartridge.

Referring now to FIG. 2, where a simplified cross sectional view of toner cartridge 200 is shown. Charging roller 84 provides the uniform electrostatic charge on photosensitive drum 83. Toner 81 is applied to photosensitive drum 83 through developer 82 roller. After the electrostatic latent image is transferred from photosensitive drum 83, any waste toner is removed and stored in waste hopper 86.

A flexible cover 85 is formed over toner 81. Flexible cover 85 collapses as toner 81 is consumed. Also shown in FIG;. 2 is cartridge seal 50. Cartridge seal 50 seals toner 81 during transportation of toner cartridge 200. Prior to inserting toner cartridge 200 into the printing apparatus 300, cartridge seal 50 must be removed. However, once cartridge seal 50 has been removed, toner 81 is allowed passage towards developer 82. With the present design of toner cartridge 200, cartridge seal 50 cannot be replaced without dissecting toner cartridge 200.

Figure 3:
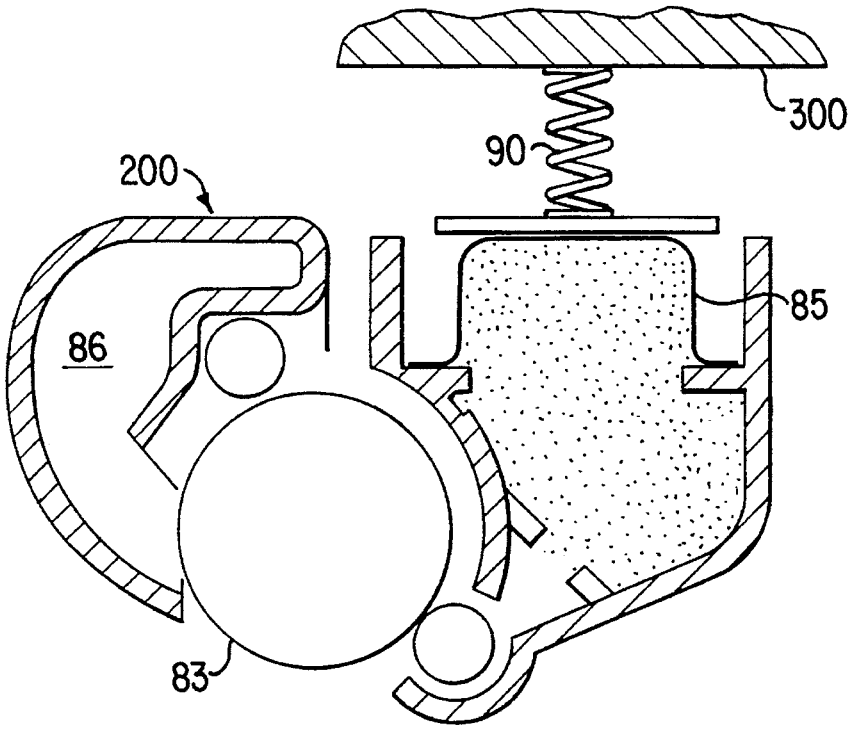
FIG. 3 is a simplified cross sectional view of a new toner cartridge showing a spring force to aid in collapsing the toner bag.

As shown in FIG. 3, in the preferred embodiment, an optional spring 90, which is attached at the upper level to a cover on the printing apparatus 300, provides positive pressure against the flexible cover 85 aiding toner 81 towards developer 82. The downward force created by spring 90 provides just enough force to insure that flexible cover 85 collapses as toner 81 is consumed. If the force created by spring 90 is too great, toner 81 will leak past developer 82 in an undesirable fashion. The exact spring force is dependent upon numerous factors, however, the predominant factor is the thickness and material type used to manufacture the flexible cover 85.

Figure 4:
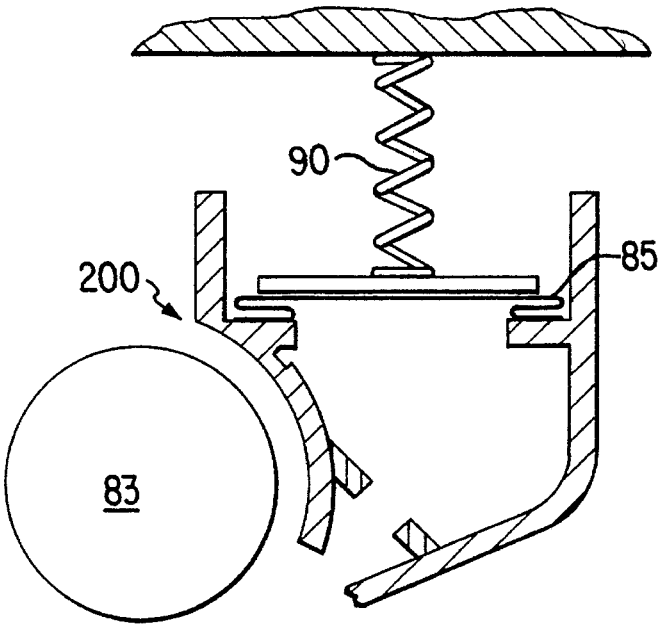
FIG. 4 is a simplified cross sectional view of an expired toner cartridge.
Figure 5:
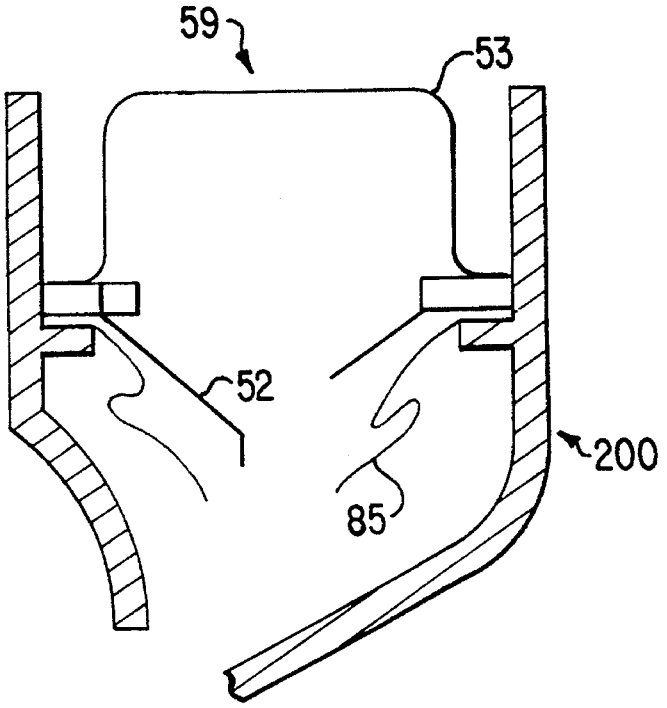
FIG. 5 is a simplified cross sectional view of the toner refill area of a toner cartridge showing the addition of a refill cartridge for refilling the toner cartridge.

FIG. 4 shows the position of flexible cover 85 and spring 90 when the toner cartridge 200 is ready for refilling. Referring now to FIG. 5, a new refill cartridge 59 attaches over the top of the consumed flexible cover 85. During shipment pull strip 87 seals the new refill cartridge 59. (See FIGS. 8 and 9.) As the user removes seal 87, knife 52 punchers the flexible cover 85 thereby allowing the new toner in refill cartridge 59 to mix with the remaining old toner 81.

Bag frame 54 seals against toner cartridge 200 during the installation of refill cartridge 59. Thus, with this operation, toner can be replenished without exposing the user to toner.

Figure 6:
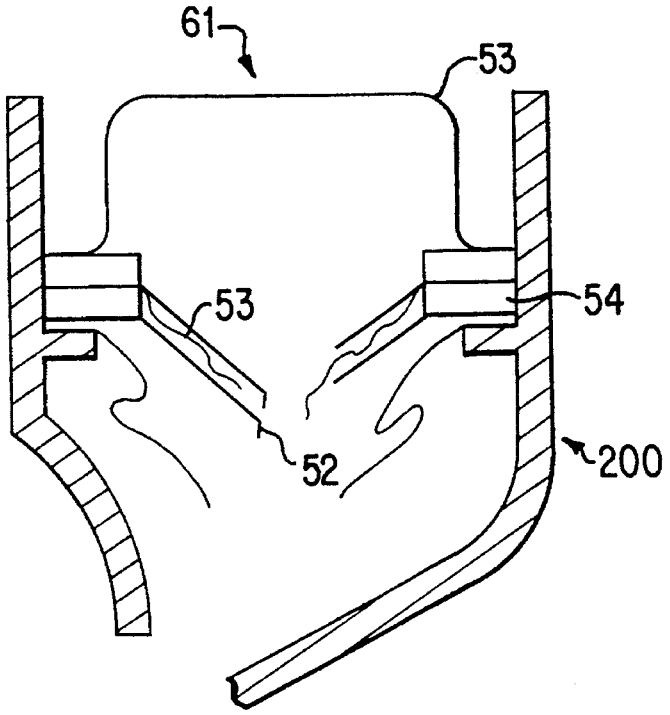
FIG. 6 is a simplified cross sectional view of the toner refill area of a toner cartridge showing the addition of a second refill cartridge for refilling the toner cartridge.
Figure 7:
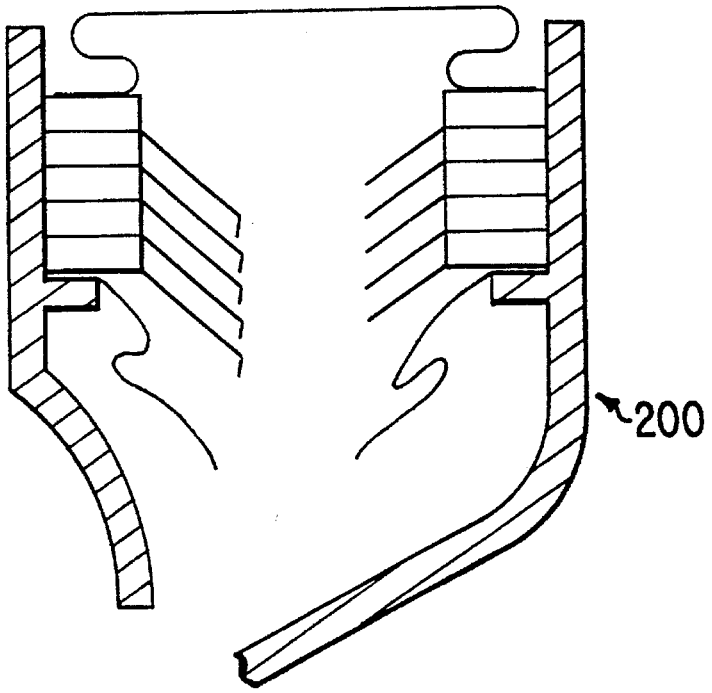
FIG. 7 is a simplified cross sectional view of the toner refill area of a toner cartridge showing the maximum number of refill cartridges for refilling the toner cartridge.

An additional refill cartridge 61 can be added to the refill area, as shown in FIG. 6. Depending upon the projected life of the toner cartridge 200, the refilling area can be sized such that a maximum number of refills can be added. By way of an example, in FIG. 7, it is assumed that the photosensitive drum 83 has and life expectancy of 6000 pages. Also it is assumed that the toner cartridge 200 is originally filled with enough toner to print approximately 1000 pages and that each refill cartridge adds an additional printing capacity of 1000 pages each. Thus, for this example, the refilling area should accept a maximum of five additional refill cartridge. As shown in FIG. 7, once the fifth refill cartridge is added, the refill area is fully occupied.

Figure 8:
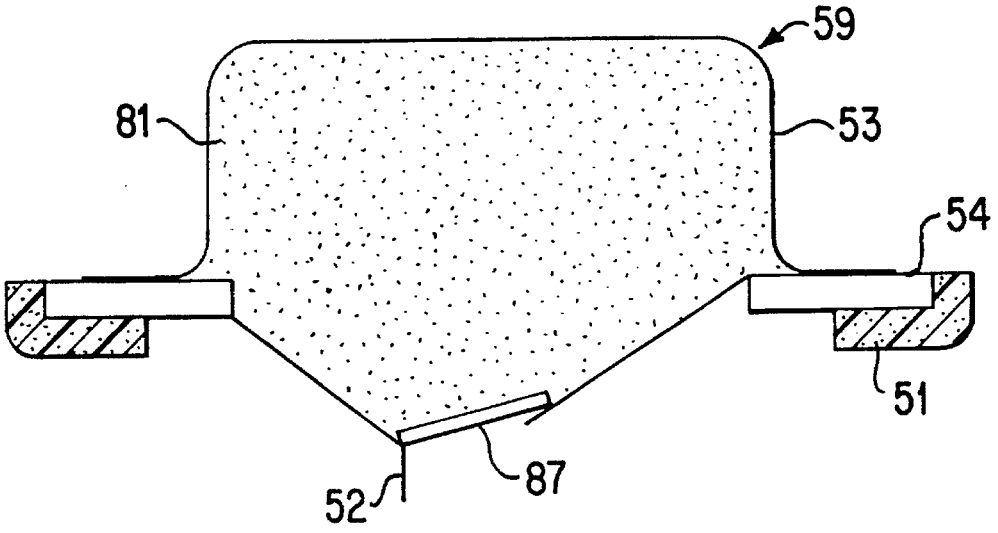
FIG. 8 is a simplified cross sectional view of the refill cartridge.
Figure 9:
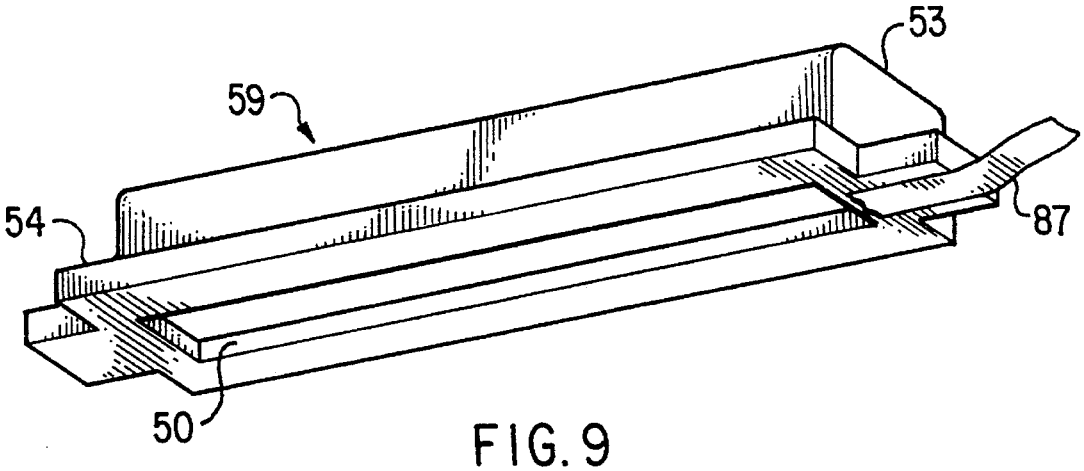
FIG. 9 is a perspective view of the refill cartridge.

Referring now to FIGS. 8 and 9, where a cross section view of the refill cartridge 59 is shown. A compressible foam 51 is formed around the bottom and outer edges of frame 54. When refill cartridge 59 is inserted in toner cartridge 200, compressible foam 51 forms a seal against the toner cartridge thereby, containing toner 81 within the toner cartridge 200.

Seal 87, which is present during shipment of refill cartridge 59, prevents toner leakage until seal 87 is removed. After refill cartridge 59 is installed in toner cartridge 200 the seal 87 is removed by the user. As seal 87 is removed, cutting edge 52 punctures the underlying toner bag allowing toner 81 to enter the toner hopper in toner cartridge 200.

Figure 10:
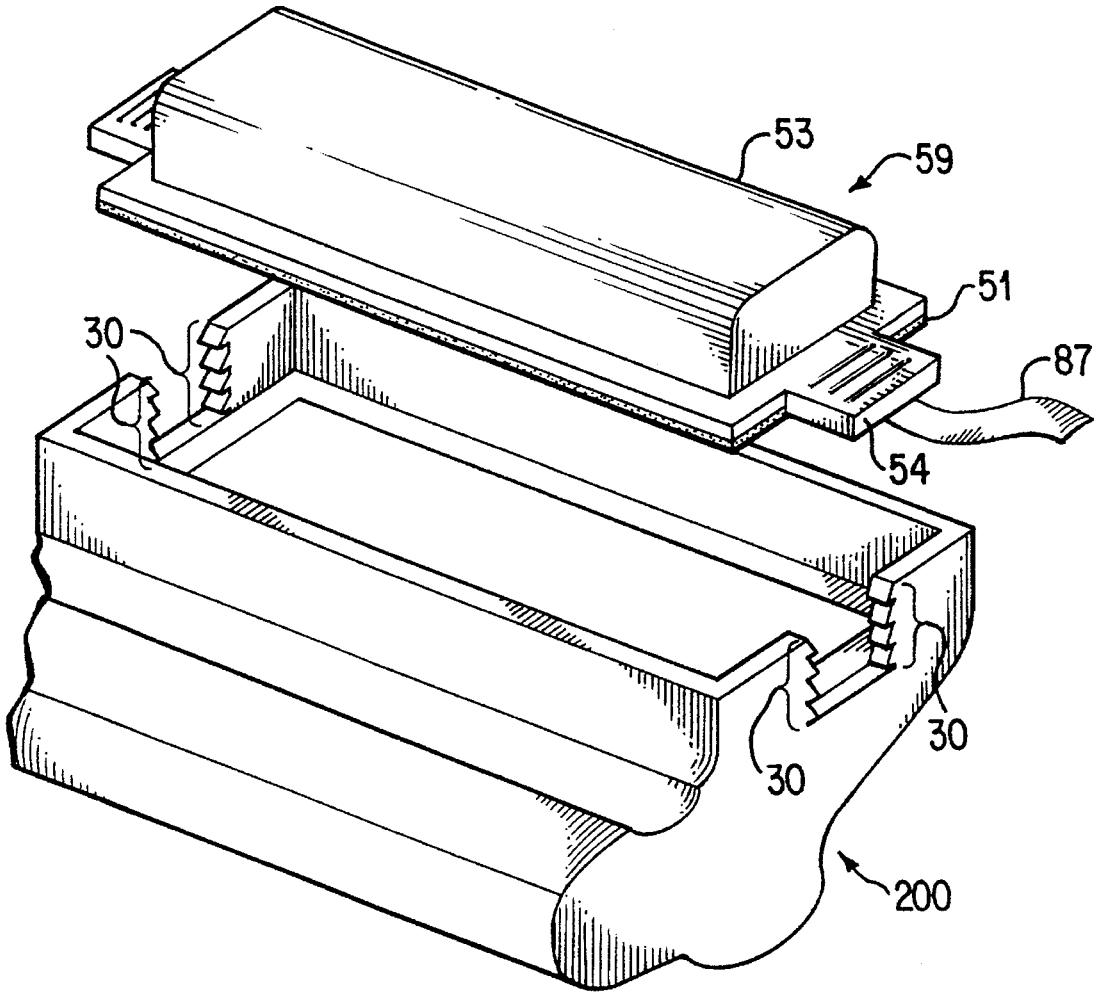
FIG. 10 is a perspective view of the toner cartridge with a refill cartridge about to be installed.

FIG. 10 gives a perspective view of toner cartridge 200 and refill cartridge 59. Upon close examination of toner cartridge 200, a plurality of snaps 30 can be seen. These one-way snaps, snap against refill cartridge frame 54 when refill cartridge 59 is inserted in toner cartridge 200.

The one way snaps 30, prevent refill cartridge 59 from being removed from toner cartridge 200 after insertion. This prevention accomplishes two important functions. First, if refill cartridge 59 were removed after pull strap 87 has been removed, there is a good chance that toner will spill out exposing the user to the messy toner. Second, as stated above during discussion of FIG. 7, many of the components within toner cartridge 200 have a limited life span. If refill cartridge 59 is removed after it has been depleted, additional toner might be added such that toner cartridge 200 is used beyond its designed life span.

Figure 11:
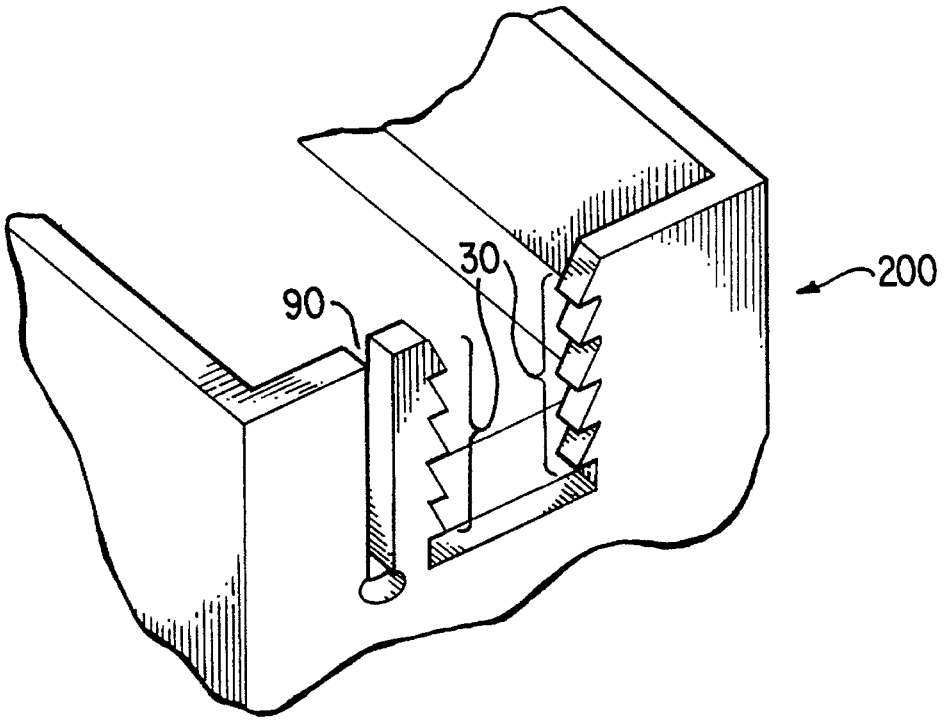
FIG. 11 is a close-up perspective view of refill cartridge locking snaps.

Referring now to FIG. 11, a close-up view of the locking mechanism as first shown in FIG. 10 can be seen. Toner cartridge 200 has a plurality of snaps 30. Also shown is cutout 90 which allows snaps 30 adjacent to cutout 90 to exhibit a slight lateral movement when additional refill cartridges are added.

Figure 12:
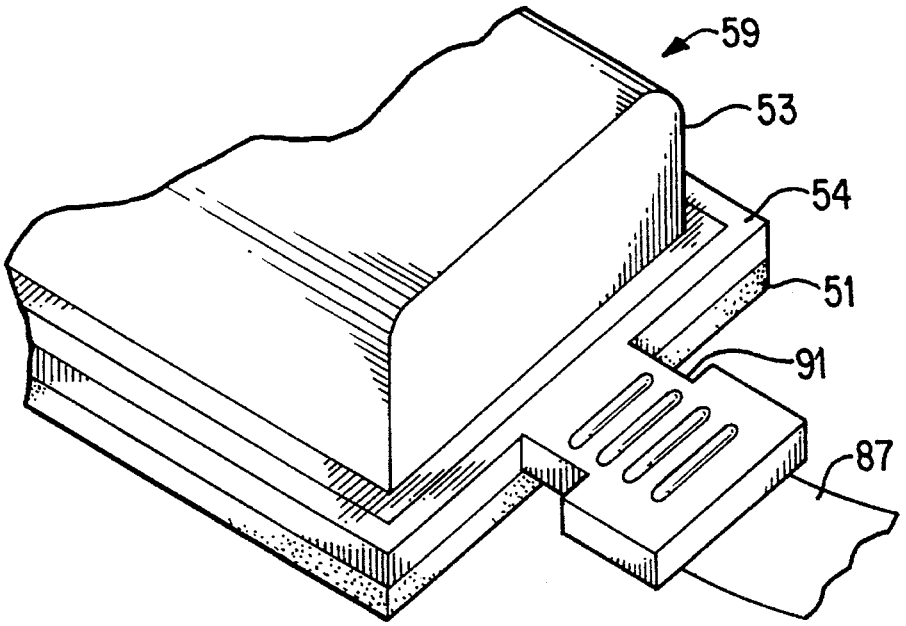
FIG. 12 is a close-up perspective view of refill cartridge.

In FIG. 12, the end of a refill cartridge 59 is shown. As before, the refill cartridge consists of a toner bag 53, frame 54, foam 51, and seal 87. Shown here, indent 91 is constructed to mate with the openings as shown in FIG. 11.

Figure 13:
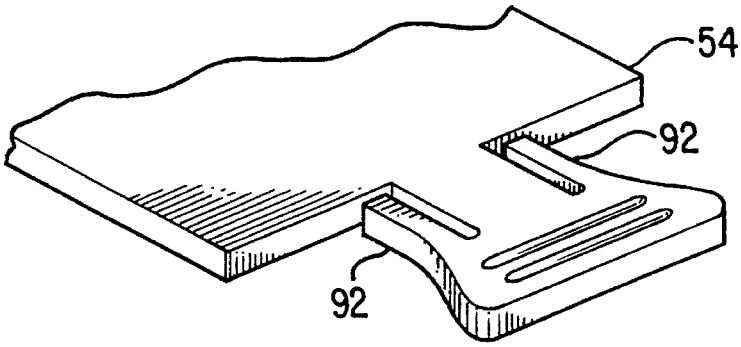
FIG. 13 in an alternative embodiment of a frame that includes spring action locking tabs.

An alternative embodiment to frame 54 is shown in FIG. 13. By using tabs 92 as shown on frame 54, the cutout 99 of FIG. 11 can be eliminated. As the refill cartridge is inserted onto the cartridge, tabs 92 compress as they pass over snaps 30. Once the refill cartridge is in place, tabs 92 expand thereby locking the refill cartridge to the toner cartridge. The two embodiments for attaching the refill cartridge to the toner cartridge shown and described here are only exemplary, other structures that accomplish the same function as understood by one of ordinary skill could be used.

Figure 14A:
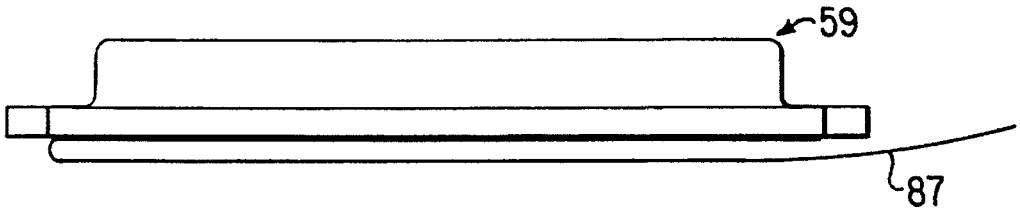
FIG. 14 shows the seal being removed.
Figure 14B:
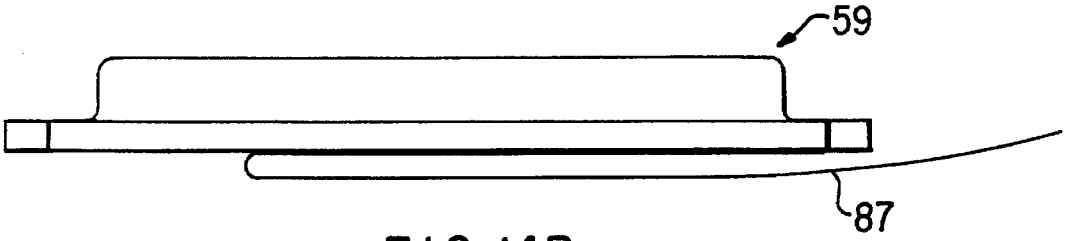

FIG. 14 shows the seal 87 being removed from refill cartridge 59. In FIG. 14A, the seal 87 is shown in its normal position. As the seal 87 is extracted by the user, the toner in refill cartridge 59 can escape. FIG. 14B indicates that the seal 87 is 50% removed.

Figure 15:
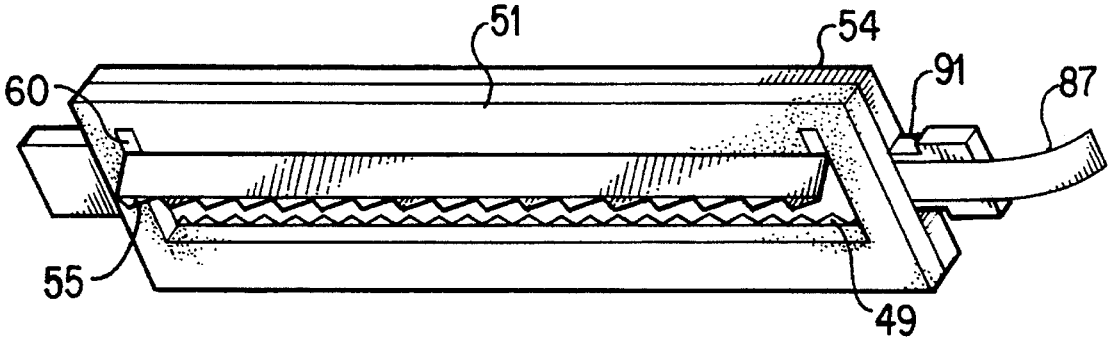
FIG. 15 is a perspective view an alternative embodiment for the refill cartridge.
Figure 16A:
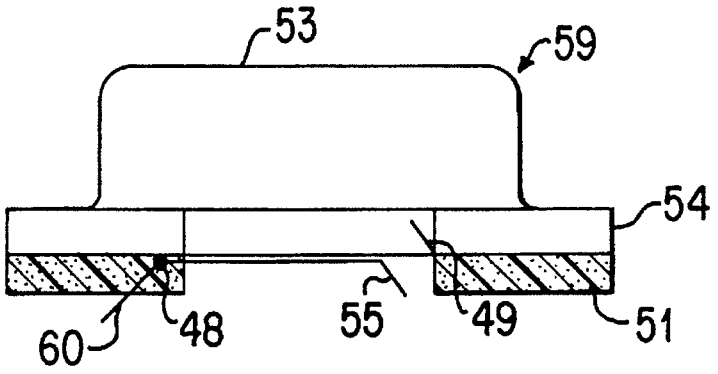
FIG. 16 is a cross sectional view of an alternative embodiment for the refill cartridge.
Figure 16B:
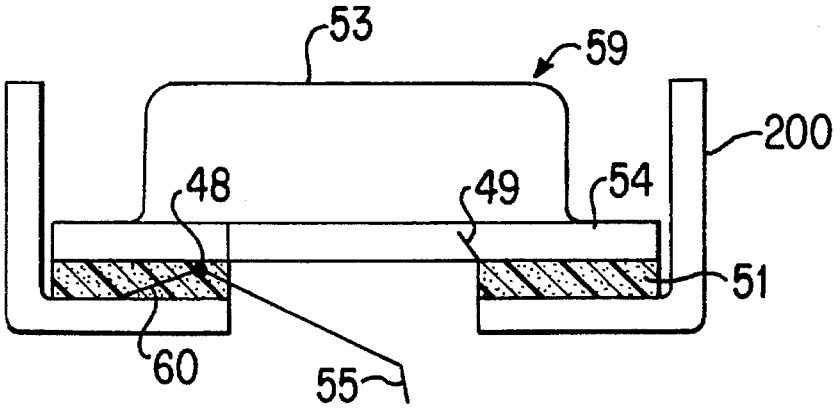
Figure 16C:
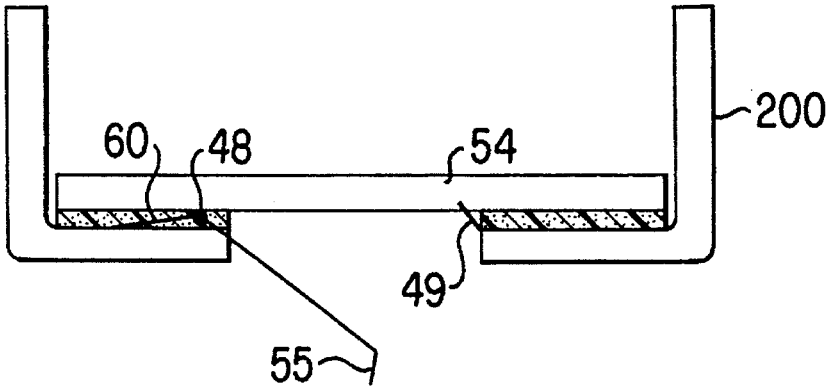

An alternative embodiment of refill cartridge 59 is shown in FIG. 15. As before, seal 87, frame 54, and foam 51 construct the refill cartridge. In this embodiment, a pair of serrated cutting edges 55 and 49 are used to aid in tearing the previous refill cartridge. In FIGS. 16A–16C, a cross sectional view of the refill cartridge of FIG. 15 is shown. There is shown a cutting edge 55 which pivots about pivot point 48. As the refill cartridge 59 is inserted into the toner cartridge 200, tab 60 is pressed against the toner cartridge housing. As foam 51 compresses, the force on tab 60 causes the cutting edge 55 to pivot about pivot point 48. There is also shown the second cutting edge 49 which aids in cutting toner bag 53 when a subsequent refill cartridge is placed over the present refill cartridge 59 area. In FIG. 16C the cutting edge 55 has completely pivoted about pivot point 48 as foam 51 compresses. Cutting edge 55 is intended to puncture the underlying previous toner bag 53.

Figure 16D:
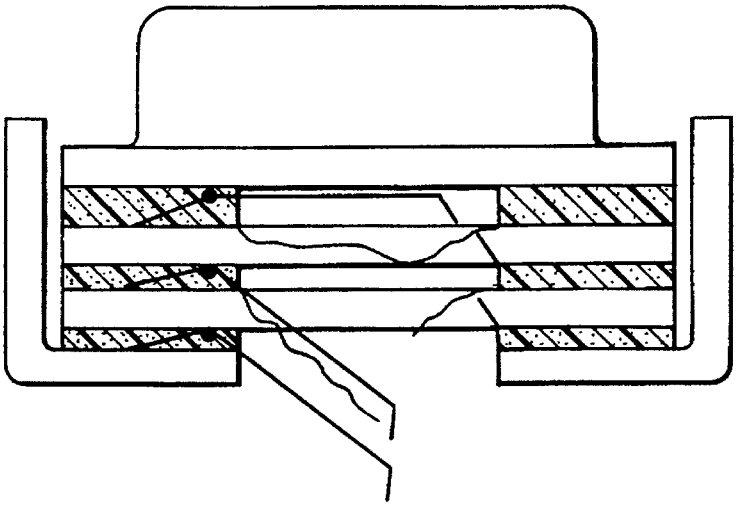

When a subsequent toner refill package is placed on top of the present refill cartridge as in FIG. 16D, blade 49 holds the present refill cartridge toner bag in place as the subsequent cutting edge pivots about its own pivot point. Thus, the upwardly thrusting cutting edge 49 provides an upward cutting force against the downward pivoting cutting action of the subsequent cartridge.

Figure 17:
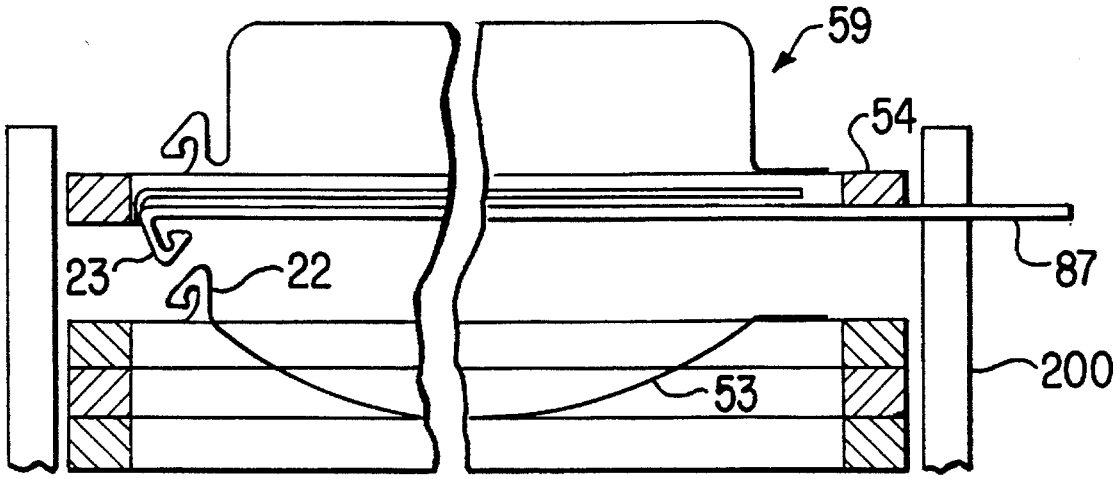
FIG. 17 in an alternative embodiment for removing the seals when installing a refill cartridge.

FIG. 17 shows another embodiment to insure that toner in a new refill cartridge is allowed passage past prior refill cartridges. As the new refill cartridge 59 is added, lower hook 23 attaches to upper hook 22 on the previous refill cartridge. Once the new refill cartridge 59 is locked in place, seal 87 is extracted to release toner from the new refill cartridge 59. Because lower hook 23 is locked to upper hook 22, extraction of seal 87 also opens the top of toner bag 53 allowing toner to refill the empty chamber.

Figure 18:
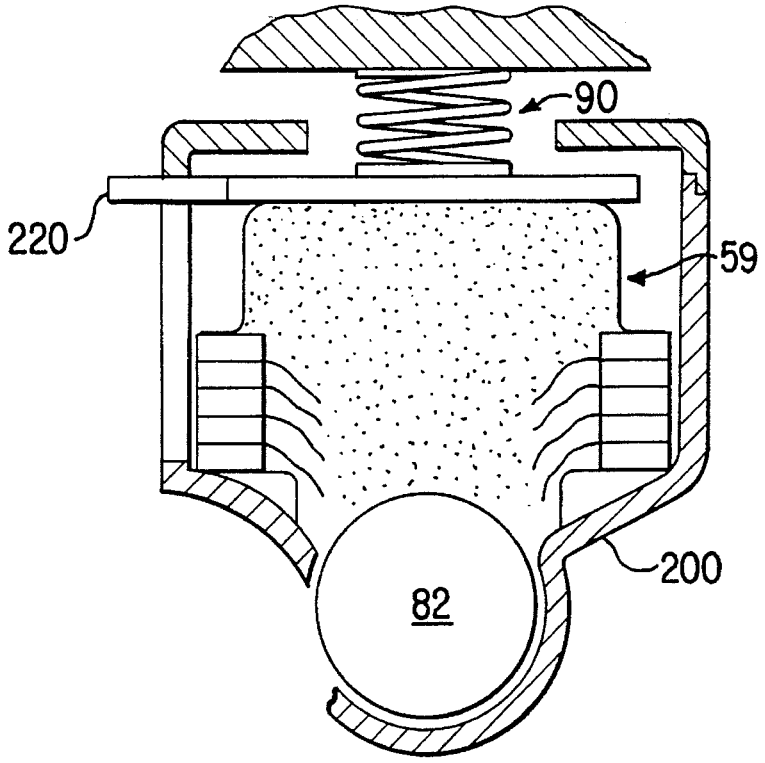
FIG. 18 is a simplified cross sectional view showing a "toner gage" to indicate an approximate amount of remaining toner.
Figure 19:
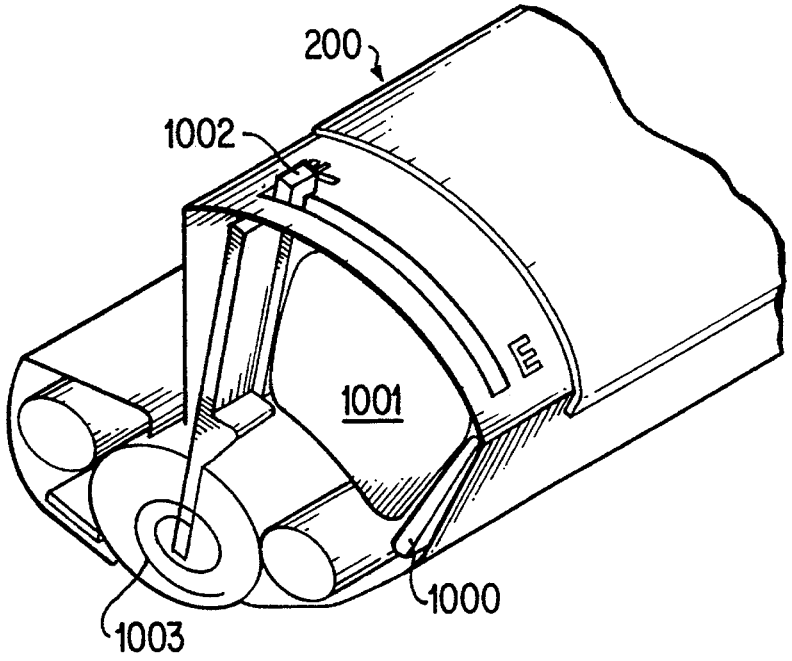
FIG. 19 in an alternative embodiment of the "toner gage."

A "toner gage" that provides a visual indication of an approximate amount of remaining toner can be constructed as shown in FIGS. 18 and 19. In the embodiment of FIG. 18, toner gage 220 moves down as spring 90 presses the toner out of the refill cartridge 59. In the embodiment of FIG. 19, toner gage 1002 rotates as a result of spring 1003 tension. As the toner in toner bag 1001 is consumed, toner gage 1002 pivots towards the "E" symbol. Also shown in FIG. 19 is exhausted toner bag 1000.

Figure 20:
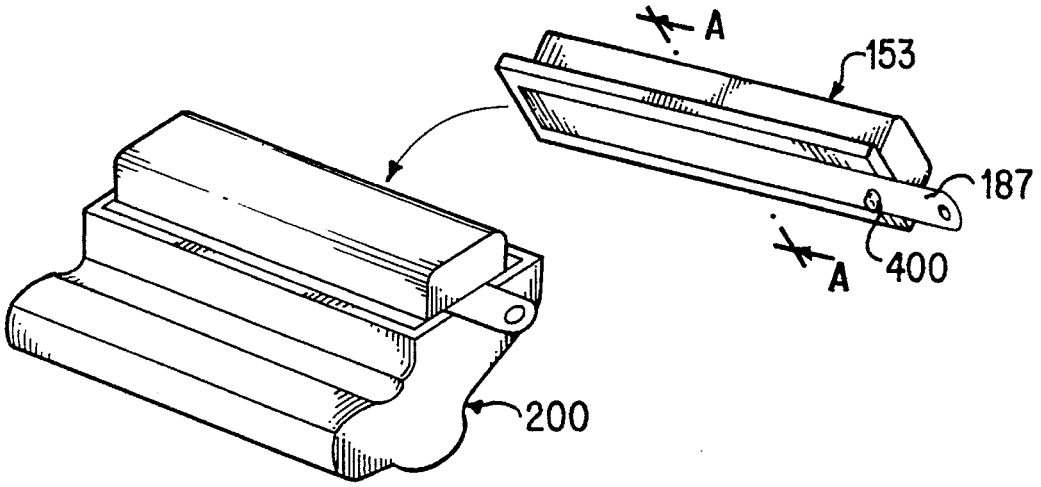
FIG. 20 is a perspective view of an alternative embodiment showing the toner cartridge with a refill cartridge about to be installed.

FIG. 20 shows an alternative embodiment to the present invention that allows only one refill pack 153 to be added to toner cartridge 200. Once the original supply of toner in toner cartridge 200 is consumed, the refill pack 153 is snapped over the top of toner cartridge 200. When refill pack 153 is attached to toner cartridge 200, tab 400 locks into receptacle 451 of cover 450. As the user withdraws seal 187, cover 450, shown in FIG. 21, is simultaneously removed, allowing toner in refill pack 153 to refill toner cartridge 200.

Figure 21:
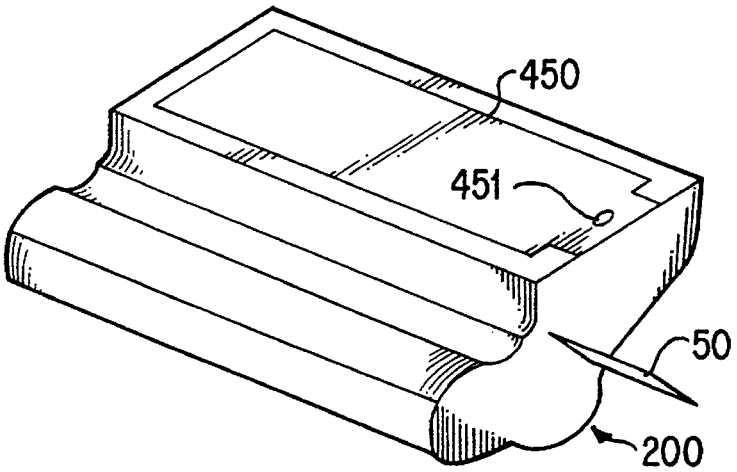
FIG. 21 is a perspective view of an alternative embodiment showing the toner cartridge.

Referring briefly to FIG. 21, in the preferred embodiment, the cover 450 is recessed so that it is only removable when refill pack 153 is installed. Also shown is the original pull strip seal 50 which the user must remove before printing with a new cartridge toner cartridge 200.

Figure 22:
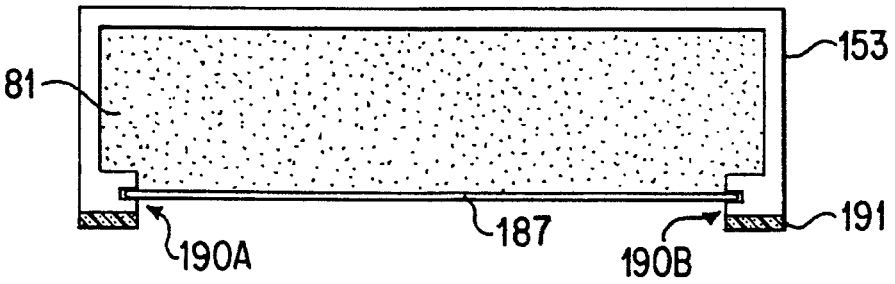
FIG. 22 is a cross sectional view of the refill cartridge along lines A—A of FIG. 20.

To better understand how refill pack 153 is constructed, FIG. 22 provides a cross sectional view along lines A—A of FIG. 20. Toner 81 is bounded by refill pack 153 and seal 187. Seal 187 slides into place along grooves 190A and 190B. Foam 191 creates a toner tight seal against toner cartridge 200 when refill pack 153 is properly installed on toner cartridge 200.

Figure 23:
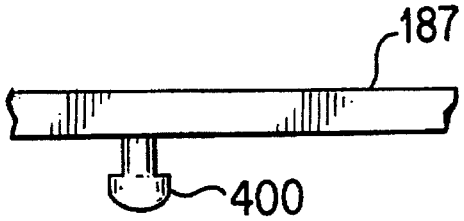
FIG. 23 is a close-up view of the locking tab.

In FIG. 23, tab 400 is more clearly shown. It should be noted that the exact shape and size of tab 400 is not important to the present invention. One skilled in the art understands that numerous embodiments exists for tab 400 provided it performs the desired function. Tab 400 must protrude through receptacle 451 and sufficiently transfer lateral forces against seal 187 to extract cover 450 along with seal 187.

Figure 24:
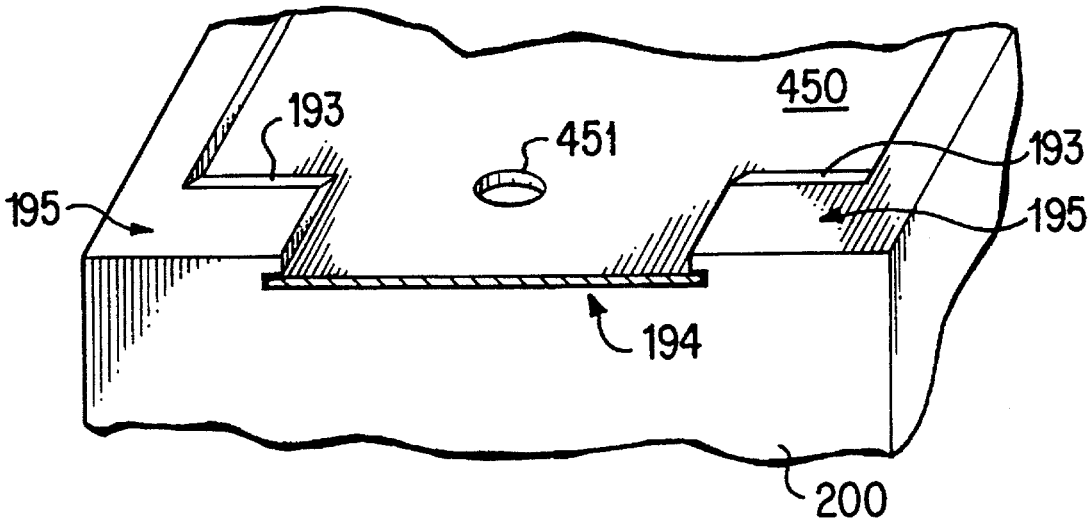
FIG. 24 is a close-up perspective view of refill cartridge receiving area of the toner cartridge.

FIG. 24 provides a close up view of the docking area between toner cartridge 200 and refill pack 153. Receptacle 451 is tightly held in place in a similar manner as seal 187. The lateral force transferred to cover 450 through receptacle 451 and tab 400 causes cover 450 to climb ledge 193. As cover 450 travels out of toner cartridge 200, the far edges of cover 450 must climb ledges 193 and ride over surface 195. Because the outer edges travel over surface 195, cover 450 experiences a slight bow.

After extraction of cover 450 and seal 187, foam 191 on refill pack 153 seals against toner cartridge 200 and simultaneously seals opening 194, thereby forming a toner tight seal between refill pack 153 and toner cartridge 200.

Figure 25:
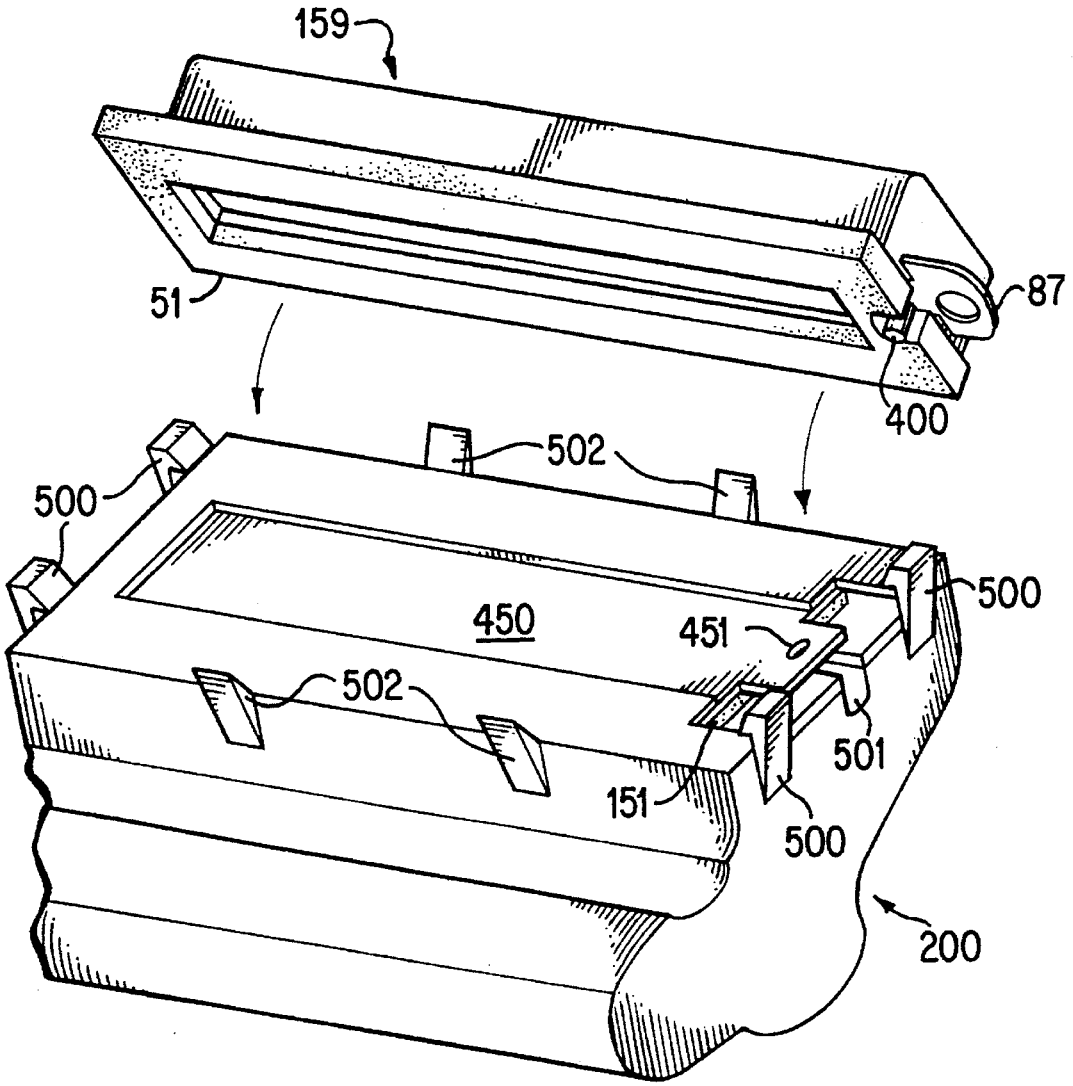
FIG. 25 is a perspective view of another alternative embodiment showing the toner cartridge with a refill cartridge about to be installed.

An alternative embodiment for the one-time refill configuration is shown in FIG. 25. Toner cartridge 200 is arranged to receive a refill cartridge 159. The refill cartridge 159 consists of a seal 87 and a tab 400. Along the lower surface of refill cartridge 159 is a self sealing foam 51. Toner cartridge 200 consist of a cover 450 which includes a receptacle 451. Also shown are four guides 502 on each side of the receiving area. Along the outside receiving area, are shown four snaps 500. These snaps rigidly attach refill package 159 to the toner cartridge.

As refill cartridge 59 is placed on top of the receiving area of toner cartridge 200, foam 51 forms a toner tight seal between the two bodies. Guides 502 insure that the refill cartridge 159 is properly aligned with the receiving area on toner cartridge 200. Snaps 500 rigidly attach the refill cartridge 159 to the toner cartridge. Tab 400 mates with receptacle 451 and insures that as the seal 87 is extracted from refill cartridge 159, cover 450 is simultaneously extracted from toner cartridge 200. Indentation 501 allows for the passage of tab 400. Finally, foam 151 on toner cartridge 200 seals the opening left after cover 450 is removed.

Although the preferred embodiment of the invention has been illustrated and that form described, it is readily apparent to those skilled in the art that various modifications may be made therein without departing from the spirit of the invention or from the scope of the appended claims.

What is claimed is:

1. An apparatus for refilling an electrophotographic imaging system, said apparatus comprising:

a pack which defines an interior volume, said pack comprising:

a frame having a top face and a bottom face, said frame having an opening extending from said top face to said bottom face;

a removable seal attached to said frame between said top face and said bottom surface along said opening;

a collapsible bag permanently attached to said top face of said frame;

developer particles contained in said interior volume of said pack; and a cartridge having a receiving area arranged to receive said pack, said receiving area further having an opening passing from within said cartridge to outside said cartridge, said apparatus further comprising a flexible cover attached over said opening in said receiving area.

2. The apparatus of claim 1 further comprising a cutting member pivotally mounted to said bottom surface of said frame.

3. The apparatus of claim 1, said pack further comprising a cutting edge attached to said removable seal.

4. The apparatus of claim 1 further comprising a means for attaching said pack to said cartridge.

5. The apparatus of claim 1 further comprising a means for indicating an amount of collapse of said collapsible bag.

6. A refill pack which defines an interior volume for filling an electrophotographic imaging system with developer particles, said refill pack comprising:

a frame having a rectangle shape and a top face and a bottom face, said frame having an opening extending from said top face to said bottom face;

a removable seal attached to said frame between said top face and said bottom surface along said opening;

a collapsible bag joined to said top face of said frame;

said developer particles contained in said interior volume of said pack; and cutting edge attached to said removable seal.

7. The refill pack of claim 6 wherein said frame further having a seal on said bottom face.

8. The apparatus of claim 6 further comprising a means for indicating an amount of collapse of said collapsible bag.

* * * * *